US008459183B2

(12) United States Patent
Weingartner

(10) Patent No.: US 8,459,183 B2
(45) Date of Patent: Jun. 11, 2013

(54) METHOD OF PRINTING PANEL MATERIAL

(75) Inventor: Peter Weingartner, Dölsach (AT)

(73) Assignee: Durst Phototechnik Digital Technology GmbH, Lienz (AT)

( * ) Notice: Subject to any disclaimer, the term of this patent is extended or adjusted under 35 U.S.C. 154(b) by 826 days.

(21) Appl. No.: 12/156,556

(22) Filed: Jun. 3, 2008

(65) Prior Publication Data

US 2009/0007811 A1 Jan. 8, 2009

(30) Foreign Application Priority Data

Jun. 4, 2007 (AT) ..... A 883/2007

(51) Int. Cl.
*B41F 1/34* (2006.01)

(52) U.S. Cl.
USPC ..... 101/485; 101/35

(58) Field of Classification Search
USPC ..... 101/35, 483, 485; 198/689.1, 813, 198/841
See application file for complete search history.

(56) References Cited

U.S. PATENT DOCUMENTS

| | | | | |
|---|---|---|---|---|
| 2,701,519 | A * | 2/1955 | McKay | 101/35 |
| 3,177,568 | A | 4/1965 | Schweiker | |
| 4,220,081 | A | 9/1980 | Hawkinson | |
| 4,230,218 | A * | 10/1980 | Kunzmann | 198/461.3 |
| 4,518,075 | A * | 5/1985 | Aykut et al. | 198/460.1 |
| 5,401,012 | A | 3/1995 | Taruki | |
| 5,852,976 | A | 12/1998 | Coudert | |
| 5,971,134 | A | 10/1999 | Trefz et al. | |
| 6,216,848 | B1 * | 4/2001 | Zens | 198/689.1 |
| 6,843,172 | B2 * | 1/2005 | Polloni et al. | 101/35 |
| 6,848,846 | B2 * | 2/2005 | Codos et al. | 400/323.1 |
| 6,857,358 | B2 * | 2/2005 | Dittrich et al. | 101/35 |
| 7,363,856 | B1 * | 4/2008 | Moulin | 101/467 |
| 2004/0036726 | A1 | 2/2004 | Zach | |
| 2006/0155420 | A1 | 7/2006 | Katayama | |
| 2007/0041762 | A1 * | 2/2007 | Ishida et al. | 399/388 |

FOREIGN PATENT DOCUMENTS

| | | |
|---|---|---|
| DE | 1 043 208 | 11/1958 |
| DE | 196 25 470 | 1/1998 |
| DE | 697 05 987 | 4/2002 |
| EP | 0 802 136 | 10/1997 |
| JP | 6-296918 | 10/1994 |
| JP | 2001-121054 | 5/2001 |
| JP | 2004-255316 | 9/2004 |
| JP | 2004-255358 | 9/2004 |
| JP | 2006-314927 | 11/2006 |

OTHER PUBLICATIONS

European Search Report mailed Nov. 23, 2012 in EP 08 01 0105.

* cited by examiner

*Primary Examiner* — Ren Yan
(74) *Attorney, Agent, or Firm* — Collard & Roe, P.C.

(57) ABSTRACT

The invention relates to a method of printing panel material (2) with a printed image, whereby the panel material (2) is moved from a feeding station (5) into a printing station (3), in which an image is applied and out of which it is fed onwards in the transport direction (4) by means of a conveyor system (18). The panel materials (2) to be printed are disposed immediately one after the other in rows (36-38) in the transport direction (4) at least in an inlet region (32) to the printing station (3) and are fed jointly through the printing station (3) during the printing operation, and the printed image is applied by means of an inkjet printing device (13).

17 Claims, 2 Drawing Sheets

METHOD OF PRINTING PANEL MATERIAL

CROSS REFERENCE TO RELATED APPLICATIONS

Applicant claims priority under 35 U.S.C. §119 of AUSTRIAN Patent Application No. A 883/2007 filed on Jun. 4, 2007.

BACKGROUND OF THE INVENTION

1. Field of the Invention

The invention relates to a method of printing panel material with a printed image, whereby the panel material is moved from a feeding station into a printing station in which the printed image is applied and from which it is fed onwards in the feed direction by means of a conveyor system.

2. Prior Art

Patent specifications EP 0 802 136 B1 respectively DE 697 05 987 T2 disclose a system and a method of decorating profiled strips. To this end, the system for decorating the profiled strips comprises a station for separating the individual strips, at which a conveyor is disposed in the conveying direction for then conveying the strips onwards. Units are provided at the separating station for holding a plurality of strips in a defined position in which the strips are moved apart from one another in parallel and disposed so that their longitudinal orientation lies parallel with the forward feed direction of the conveyor. The separating station also has other units for transferring the strips to the subsequent conveyor once they have assumed the defined position. A guide station for the strips is disposed in the displacement path of the strips moved by the conveyor in the operating direction upstream of the printing station, and this guide station has spacer guides which are designed to co-operate with the strips in the region of their longitudinal edges. Consequently, the strips slide between these guides and are forced to assume their defined position prior to entering the printing station. Also for positioning the individual strips, stops are also provided in the region of the guide station, which can be displaced from a position extending into the transport path into a position outside of the transport path. These stops position the individual strips by reference to the rotatable printing drum used to apply the printing ink to the surface of the individual strips. The individual strips are therefore printed in groups of several strips disposed adjacent to one another and a separate positioning operation is needed for the strips to be printed before running every printing operation.

U.S. Pat. No. 5,401,012 A describes a document feed mechanism for a copier, comprising a separator device and a conveyor system for the separated sheets or documents. The separator device comprises separator rollers and conveyor rollers and the separator rollers feed documents individually from a stack to the conveyor rollers. The latter then transfer the separated sheet to the subsequent conveyor system, and two respective documents are positioned in 2 in 1 mode edge to edge one after the other and deposited on the contact glass or document glass for the subsequent reading and copying operation on a single sheet. This is done by the separator rollers, which separate a first sheet from the stack and convey it to the conveyor rollers. They convey the first separated sheet until what is the rear edge as viewed in the transport direction is detected by means of a sensor. This signal triggers the separation of a second sheet from the stack. As soon as the sensor detects what is the front edge of the second sheet as viewed in the transport direction, the separating process and transport of the first sheet are interrupted. The position of the second sheet remains unchanged between the conveyor rollers until the first sheet has been moved in the direction opposite the transport direction by means of the conveyor system so that it abuts edge to edge with the second sheet. The two sheet edge to edge are then moved by the conveyor system to the predefined position on the contact glass or document glass. After the reading and copying operation, the original documents are conveyed onwards away from the reading area disposed in the copying position without any change.

Patent specification DE 196 25 470 A1 discloses a method and a device for conveying objects, whereby a plurality of objects is fed by a feed conveyor to an adjoining conveyor. From the adjoining conveyor, the individual objects are transferred to an accumulating conveyor so that a sufficient number of objects is always supplied to a separator conveyor in readiness for separating them subsequently. From the accumulating conveyor, the objects disposed one after the other are transferred to the separator conveyor separately at specific distances.

Patent specification DE 1 043 208 discloses an overlapping device for panel metal processing plants. In this instance, the panel to be separated is transferred from a first conveyor to another conveyor disposed downstream of it. As this happens, the conveying speed of the first conveyor is selected so that it is higher than that of the second conveyor. As the separated panel is transferred from the first conveyor to the second conveyor, a plate, the position of which can be adjusted, is provided at the overhanging end of the first conveyor belt and is moved above the inlet end of the second conveyor belt, thereby ensuring that a subsequent panel does not make contact with the rear edge of the panel in front and instead, the front and rear edges of the panel overlap correctly. To this end, the adjustable plate is designed so that it can be displaced automatically with the aid of a control system, which operates as a function of the speed of the first conveyor belt.

SUMMARY OF THE INVENTION

The underlying objective of this invention is to propose a method of printing panel material, whereby the productivity of the printing station can be increased.

This objective is achieved by the invention due to the fact that the panel materials to be printed are disposed immediately one after the other in a row in the transport direction, at least in an inlet region to the printing station, and are fed jointly through the printing station during the printing process, and the printed image is applied by means of an inkjet printing device.

The surprising advantage obtained as a result of the combination of features making up the method steps defined in claim 1 resides in the fact that, because the panels are aligned in a row one immediately behind the other, the loading and discharging cycle in and out of the printing station with every printing operation to be run is avoided. This results in a virtually endless application of the printed image over a plurality of panels disposed one after the other. The printed image can be applied simultaneously in this way to a large surface area during the continuously running printing operation, which must be set up depending on the longitudinal extension of the individual panels in the transport direction. As a result, the printed image can easily be adapted to different panel sizes. Furthermore, a high quality of the printed image can be obtained. In addition, no lengthier downtimes are needed to apply the print medium between the loading and discharging times as would otherwise occur, thereby avoiding drying and possible sticking or blocking of the print device, in particular the print heads. Another advantage is a high output of printed panels because they are conveyed more or less continuously through the printing station and printed. This enables even better usage of the capacity of such expensive and high-quality printing stations, whilst always maintaining a constant print quality.

An approach based on the characterising features of claim 2 is also of advantage because the surface to be printed is continuous in the longitudinal extension with the exception of an extremely negligible region in spite of being in the form of individual panels and it is therefore possible to print right up to the outermost edge without any mess on the conveyor belt disposed underneath.

Another advantageous approach is defined in claim 3, whereby the rows of panel material to be printed are always moved so that they abut in mutual contact with another, which means that the individual panels to be printed form a virtually uninterrupted surface to be printed without the need for highly complex mechanisms.

Another variant of the method defined in claim 4 is of advantage because the printed image to be applied is disposed in a predefined orientation relative to the panel material to be printed, which is guided through the printing region exactly oriented by reference to the transverse movements of the print carriage.

An approach based on the characterising features of claim 5 is also of advantage because it enables even higher productivity of the printing station to be achieved. The printed image can be applied simultaneously to several panels disposed adjacent to one another during the reciprocating movement of the print carriage as a result.

Another advantageous approach is defined in claim 6, whereby possible errors in the angle of orientation between the individual rows can be compensated, thereby enabling each of the individual rows to be fed through the printing station in an exactly parallel orientation by reference to the transport direction.

Another variant of the method defined in claim 7 is of advantage because it enables an exactly pre-definable forward feed movement to be achieved for the panel material to be printed as it is fed through the printing station by the conveyor system. It also results in a correct setting of the mutual position of the individual panels relative to one another.

An approach based on the characterising features of claim 8 is also of advantage because the entire contact surface means that the panel material sits flat in the printing region. This results in sufficient adhesive friction of the panel material on the conveyor system, in particular on the conveyor belt, which is enough to ensure an exact onward conveying movement. This also obviates the need for awkward pressing mechanisms which have to be adjusted to suit different thicknesses of material to be printed.

Another advantageous approach is defined in claim 9, whereby the panel material is exactly transferred and positioned in the inlet region already, starting from the feeding station through to the conveyor system of the printing station.

Also of advantage is a variant of the method defined in claim 10 because an exact orientation and positioning of the start of printing can be achieved in the printing region with respect to the disposition and position of the terminal edge of the panel material to be printed. As a result of this pre-positioning, the transport path needed later is fixed to a high degree of accuracy up to the start of printing and is maintained by the conveyor system in the printing station.

An approach based on the characterising features defined in claim 11 is also of advantage because panel material is not printed in error and it is possible to intervene in the printing process even before a corresponding correction occurs.

Another advantageous approach is defined in claim 12 or 13, whereby the printing operation is not initiated unless panel material is definitely present, which also reduces downtimes and thus increases the productivity of the plant as a whole.

Also of advantage is a variant of the method defined in claim 14 because damage to the panel material is avoided and in addition, there is an exact orientation of the start of printing with respect to the individual panel materials in terms of the printing region.

An approach based on the characterising features defined in claim 15 is also of advantage because panel material is not printed in error, which avoids generating waste.

Another advantageous approach is defined in claim 16, whereby the individual panel elements can be re-oriented with respect to one another. In addition, mutual damage to the panel material is avoided and the printing operation can be quickly re-started.

Finally, a variant of the method defined in claim 17 is of advantage because on the one hand no panel material can be fed incorrectly and if the printing operation has started, it can easily be terminated, thereby avoiding waste.

BRIEF DESCRIPTION OF THE DRAWINGS

The invention will be explained in more detail below with reference to examples of embodiments illustrated in the appended drawings. Of these.

DETAILED DESCRIPTION OF PREFERRED EMBODIMENTS

Figure 1:
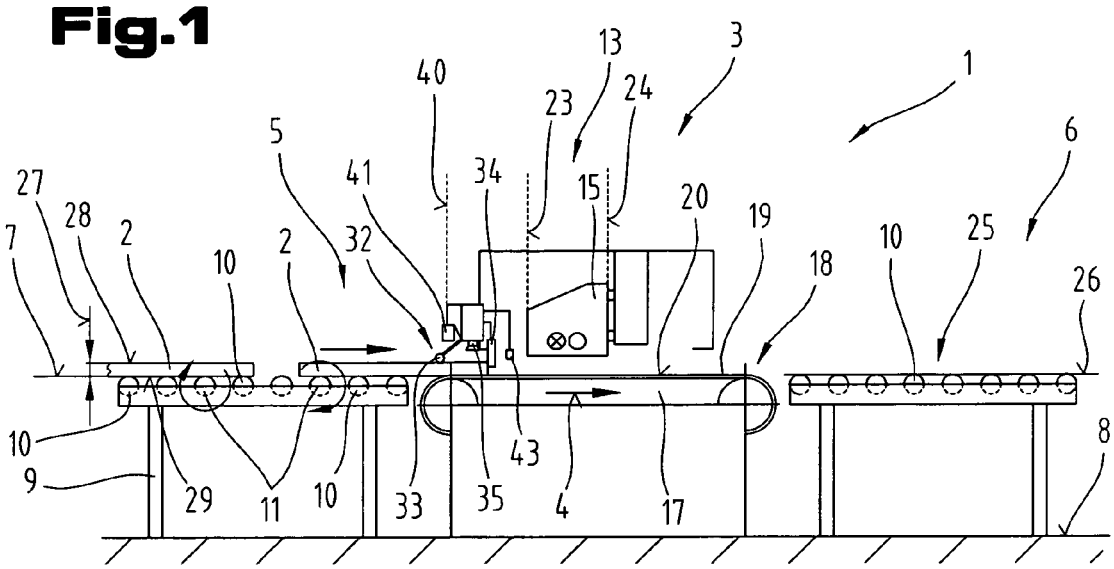
FIG. 1 is a highly simplified, schematic diagram showing a side view of a plant for implementing the method proposed by the invention for printing panel material.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

The embodiments illustrated as examples represent possible design variants of the plant 1 and the way in which the method of printing panel-format objects is implemented, and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

Figure 2:
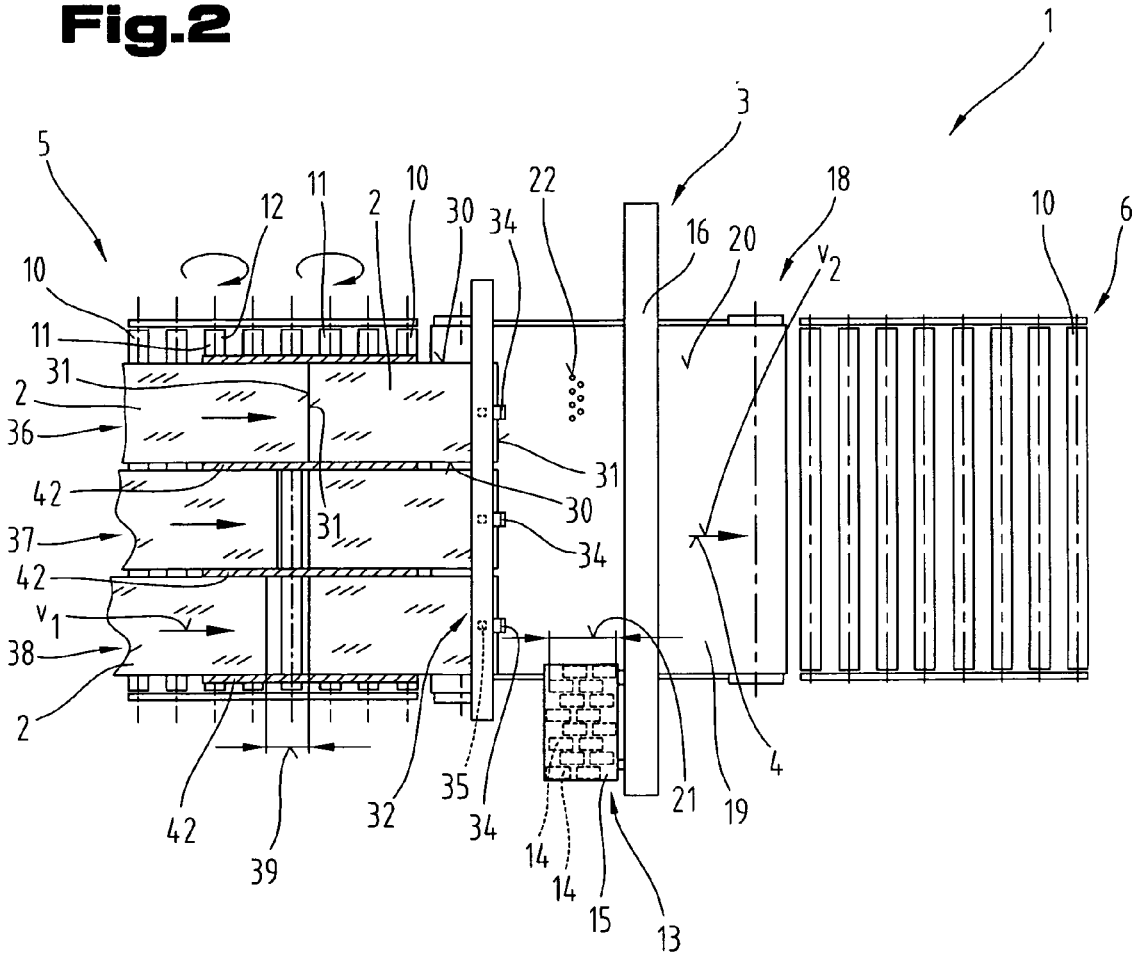
FIG. 2 is a highly simplified, schematic diagram illustrating a plan view of the plant illustrated in FIG. 1.

FIGS. 1 and 2 provide a simplified, schematic illustration of a plant 1 for printing different panel-format objects, in particular panels or panel material 2.

The plant 1 comprises a printing station 3, a feeding station 5 disposed upstream of it in the transport direction 4 and, upstream of the printing station 3 in the transport direction 4, a pick-up and discharge station 6. The feeding station 5 may also be termed an inlet table and the discharge station 6 an outlet-end table.

The feeding station 5 forms a bed plane 7 for the panel material 2, which is preferably oriented generally parallel with a standing plane 8 of the plant 1. In this respect, the standing plane 8 may be a hall floor or similar. The bed plane 7 preferably extends through the printing station 3 and through the discharge station 6 in the same plane. In the embodiment illustrated as an example here, the feeding station 5 comprises a support and table frame 9, on which at least one or more support elements 10 are disposed and retained. This or these support elements 10 are provided in the form of support rollers in the embodiment illustrated as an example here and define the bed plane 7 for the panel material 2 on their side directed away from the standing plane 8. The feeding station 5 further comprises yet another conveyor system and additional drive means 11 for conveying the panel material in the transport direction 4. In the embodiment illustrated as an example here, these are provided in the form of drive rollers 12, which cause the panel material 2 to be conveyed in the transport direction 4. To retain clarity in the drawings, the drive mechanisms co-operating with the drive means 11 have been omitted, but these may be freely selected from any of the systems known from the prior art. Instead of the drive rollers 12, the drive means 11 may also be provided in the form of driving gears, conveyor belts or similar.

The individual panels or panel material 2 may be deposited on the feeding station 5 constituting the bed plane 7 manually or may be mechanically assisted.

In the embodiment illustrated as an example here, the printing station 3 for applying the printed image is provided in the form of an inkjet printing device 13 with one or more print heads 14. However, it would also be possible to use other types of printing devices to implement the method. The print head or heads 14 is or are disposed in a print carriage 15 in a known manner. The print carriage 15 with the print head or heads 14 disposed on it is moved backwards and forwards in the direction orthogonal to the transport direction 4 above the panel material 2 to be printed and the desired printed image is thus applied to the panel material 2. To this end, the print carriage 15 is mounted on a support arm 16, illustrated in a simplified manner, so that it can be guided in displacement.

The printing station 3 has yet another printing table 17 and another conveyor system 18 which, in the embodiment illustrated as an example here, is provided in the form of a conveyor belt 19. The conveyor system 18 also constitutes another bed plane 20 on the side directed away from the standing plane, which is preferably disposed and oriented in the same disposition or position as the bed plane 7 of the feeding station 5. This results in a flat transfer from the feeding station 5 through to the printing station 3. Again in order to retain clarity in the drawings, the drive mechanism for the conveyor system 18 has been omitted and only the driving movement is indicated by an arrow in the region of the deflection for the conveyor belt 19 illustrated upstream.

In order to set the mutual positioning of the panel material 2 to be printed on the conveyor system 18, in particular in the printing region 21 formed by the print carriage 15 and the print heads 14, the conveyor belt 19 may have openings or orifices 22, which communicate with a vacuum chamber in the printing table 17 or open into it, although this is not illustrated. As a result of these openings or orifices 22 and the vacuum pressure generated there, it is possible to hold the panel material 2 relatively firmly relative to the conveyor belt 19, at least as it passes through the printing region 21. This results in a flat disposition of the panel material 2 at least in the printing region 21 and hence a flat orientation with respect to the bed plane 20. This mutual fixing of the position due to suction is usually effected across the entire longitudinal extension of the conveyor system 18 as viewed in the transport direction 4.

As also illustrated in a simplified manner in FIG. 1, a print start 23 is disposed or provided at the start of the print carriage 15 and foremost print head 14 in the transport direction 4, which is indicated by a broken line and represents the start of the printing region 21. The end of the printing region 21 disposed upstream represents a print end 24 or the end of the printed image.

Adjoining the printing station 3 disposed upstream as viewed in the transport direction 4 is the discharge station 6, which in this instance is provided in the form of a depositing and pick-up table 25 with freely selectable support means. These may in turn be formed by support elements 10 of the type described above in connection with the feeding station 5. The discharge station 6 also in turn constitutes a bed plane 26 due to the support elements 10 on the side directed away from the standing plane 8, which is likewise preferably disposed and oriented in the same position or disposition as the two bed planes 7 respectively 20 described above.

The plant 1 described here is used to implement a method of printing the panel material 2, whereby the panel material 2 is moved from the feeding station 5 into the printing station 3. In the printing station 3, at least one or more printed images is or are applied to the panel material 2 which is fed onwards in the transport direction 4 during the course of the printing operation or once it has ended by means of the conveyor system 18. In the embodiment illustrated as an example here, the onward transport and transfer is to the discharge station 6.

By panel material 2 in this context is meant panel-shaped objects, which have side faces 28, 29 spaced apart from one another by a panel thickness 27 and end faces 30 respectively 31 extending in between. In the panel format illustrated here, the two oppositely lying end faces 30, which are oriented in the parallel direction by reference to the transport direction 4, constitute longitudinal side edges of the panel material 2. The end faces 31 lying transversely or orthogonally thereto are shorter than the end faces 30 and constitute transverse side edges of the panel material 2. The panel material 2 may be advertising boards, furniture boards, furniture panels, partition walls, timber boards, coated boards made from timber material, moulded boards, hard fibre boards, etc., for example, which have a bigger thickness than paper, cardboard or paperboard.

In an inlet region 32 to the printing station 3, one or more pressing mechanisms 33 are provided upstream of the print carriage 15 and print heads 14 as viewed in the transport direction 4, which press against the panel material 2 transferred or fed on from the feeding station 5 to the conveyor system 18 of the printing station 3, in particular against the conveyor belt 19, in the direction towards it. This pressing mechanism 33 may be provided in the form of one or more pressing rollers, which apply a sufficient pressing pressure in the direction perpendicular to the side faces 28, 29 towards the conveyor system 18. Also disposed in the inlet region 32 between the pressing mechanism 33 and the schematically illustrated print start 23 of the printing region 21 is at least one but preferably several stop elements 34. It or they is or are disposed upstream of the pressing mechanism 33 by reference to the transport direction 4.

At least one, preferably several detection devices 35 are also disposed or provided in the inlet region 32 of the printing station 3. This detection device 35 may be provided in the form of a sensor, for example, which detects whether panel material 2 to be printed is disposed in the inlet region 32 of the printing station 3 and/or whether the panel material 2 has also been correctly oriented and loaded. This detection device 35 may be upstream of the pressing mechanism 33 as view in the conveyor system 4, in other words between it and the stop element 34. Alternatively, however, it would also be possible to dispose the detection device 35 in the region of the stop element 34 in order to detect whether the panel material 2 is lying correctly against the stop element 34. Another option would be to provide several of these detection devices 35 one after the other in the conveyor system 4, in which case not only can the presence of the panel material 2 material be detected, but also whether it is disposed correctly on the stop elements 34.

In the method sequence described here, the panel materials 2 to be printed are disposed one immediately after the other in a row 36—see FIG. 2—as viewed in the transport direction 4, at least in the inlet region 32 to the printing station 3, and are moved jointly through the printing station 3 during the printing operation. Having said that the panel materials 2 are disposed immediately one after the other, what is meant is that panel materials 2 disposed and oriented in the transport direction 4 are moved into mutual abutment by their end faces 31 facing one another. Accordingly, the end faces 31 are oriented transversely to the transport direction 4 and constitute the shorter transverse faces of the panel materials 2, as described above.

Before starting the printing operation, the panel material 2 is deposited in the feeding station 5 and manually and/or automatically moved or pushed along the bed plane 7 until it is disposed underneath the pressing mechanism 33. In this initial position prior to the start of printing, the stop element or elements 34 is or are in a position in which they extend into the transport path of the panel material 2 to be printed and thus afford a defined contact point for the panel material 2 disposed in the inlet region 32. From the pressing mechanism 33, the panel material 2 is fed farther along in the transport direction 4 until it lies in contact with the stop element 34. This may be done by the conveyor system 18.

In order to form the row 36 of panel materials 2, another panel 2 is deposited on the feeding station 5 and is thus disposed at a distance 39 from the panel material 2 lying against the stop element 34 as viewed in the transport direction 4, as illustrated in the other rows 37, 38 of panel material 2 parallel with the first row 36.

Disposed in the inlet region 32 and positioned by the stop element or elements 34, the panel material 2 is sensed or detected by the detection devices 35 in the row or rows 36 to 38 and a first signal indicating their presence is emitted. The signal may be an electrical, optical or any other signal, and the signal is transmitted and processed in a manner known per se. When this first signal indicating the presence of the panel material 2 in at least one of the rows 36 to 38 is detected and transmitted, it prompts the stop element 34 of this row 36 to 38 of panel materials 2 to shift or move from the position extending into the transport path into the position releasing the transport path, optionally via an interconnected control device, although this is not illustrated. In order to retain better clarity in the drawings, the connecting wiring, control units and actuators for the stop element 34 have been omitted from the drawings.

If there are several rows 36 to 38 of panel material 2 to be printed in the transport direction 4 in the printing station 3, a detection device 35 is provided in each of the individual rows 36 to 38, which detects separately for each of the rows 36 to 38 that the panel material 2 is correctly positioned and whether the panel material 2 is abutting or in contact with the respective stop elements 34. Once each of the detection devices 35 in the individual rows 36 to 38 detects such a presence, a first signal is in turn emitted by each of the detection devices 35, simultaneously prompting the respective stop element 34 co-operating with each row 36 to 38 to move from the position extending into the transport path into the position releasing the transport path. Accordingly, the panel material 2 is moved in the forward feed or transport direction 4 from the predefined position against the stop element or elements 34 into the printing region 21 by the conveyor system 18. The stop element 34 may be provided in the form of a single, continuously designed component or alternatively by several components separated from one another.

As viewed in the transport direction 4, the printing region 21 starts at the print start 23 indicated by a broken line in FIG. 1, to which the panel material 2 to be printed is fed by the conveyor system 18. With effect from the print start 23, the panel material 2 is displaced in a conventional stop and go movement and thus fed through the printing station 3 and hence the printing region 21 and is printed by means of the print carriage 15 extending orthogonally with respect to the transport direction 4.

Whilst the panel material 2 in the row or rows 36 to 38 is being printed, another panel material 2 is manually and/or automatically deposited at the feeding station 5. To ensure perfect printing and correct positioning of the printed image on the panel material 2, the panel materials 2 to be printed and disposed one after the other in rows 36 to 38 are oriented parallel with the transport direction 4 in the feeding station 5. To achieve contact of the mutually facing end faces 31 with virtually no gaps or no gaps at all, the other panel material 2 in the feeding station 5 is fed to the printing station 3 at a feed rate which is selected so that it is higher than the feed rate of the conveyor system 18 in the printing station 3. In FIG. 2, the higher feed rate in the feeding station 5 is indicated by a longer arrow "$v_1$" whilst that in the printing station 3 is indicated by a shorter arrow "$v_2$".

The panel material 2 is fed through the feeding station 5 by the drive means 12 described above, for example the drive roller 12 or drive rollers 12. Due to the higher displacement or feed rate of the panel material 2 through the feeding station 5, the distance 39 between the panels 2 disposed one after another in the row 38 is thus reduced, as illustrated in FIG. 2, until this distance 39 has been completely eliminated, as illustrated in the case of the two panel materials 2 in row 36. The panel materials 2 must arrive in this end to end contact by the latest at position 40 in the inlet region 32 indicated by a broken line in the region of the pressing mechanism 33. In this position 40, another detection device 41 may be provided for each of the individual rows 36 to 38.

If one of the two detection devices 41 and/or 35 ascertains or signals that there is nevertheless still a gap between the panel materials 2 disposed one after the other in a row 36 to 38 in the region of position 40, the drive means 11—in this instance the drive rollers 12—of the feeding station 5 are switched off and the stop element 34 co-operating with the respective row 33 to 38 is moved into the blocking position extending into the transport path. The printing materials 2 still in the process of being printed continue to be printed until the end of the printing operation so that the printed image is completed.

Due to the fact that no other panel material 2 can be fed into the inlet region 32 from the feeding station 5 whilst the printing operation is being completed, the detection device 35 and/or 41 senses or detects that there is no panel material 2 in the inlet region 32 and the stop elements 34, which until this point have not been extending into the transport path, are now moved into the position in which they extend in the transport path of the panel material 2. The panel material 2 of one or all of the rows 36 to 38 for printing are then fed onwards as far as the stop element or elements 34. If the detection devices 35 and/or 41 detect and signal the presence and the correct position of the panel material 2 in rows 36 to 38 ready for printing, a new printing operation is started by moving the individual stop elements 34 into the position in which they no longer extend into the transport path of the panel material 2.

As may be seen from the diagram shown in FIG. 2, the panel material 2 forms several rows 36 to 38 adjacent to one another. This being the case, the individual panels 2 may either lie in abutment end to end in the region of the longer end faces 30 or, as illustrated in FIG. 2, guide elements 42 are disposed between them. Consequently, the individual rows 36 to 38 of the panel material 2 are spaced apart from one another in the direction extending transversely to the transport direction 4. In order to adapt to different widths of material to be printed, the guide elements 42 can be moved in the direction orthogonal to the transport direction 4. It should be pointed out that the number of rows 36 to 38 illustrated has been selected merely as an example of possible rows but is not restricted to the actual number of rows 36 to 38 illustrated.

Due to the fact that the panel materials 2 are disposed directly one after the other, the detection device 35 and/or another detection device 43 optionally provided directly upstream of the printing region 21 can sense or detect the start and end of each of the individual panels 2, thereby enabling the exact longitudinal extension of the panels 2 to be determined. It is therefore possible to orient and position the printed image and hence the associated printing operation exactly to each of the individual panels 2. This also enables size tolerances and length differences of the individual panels 2 to be compensated and corrected when it comes to applying the printed image.

The movement of the stop elements 34 into the position in which they project or extend into the transport path of the respective row 36 to 38 of panel materials 2 may also be programmed or initiated in parallel with the running of the printing operation or deliberately prompted by an operator of the plant 1 in order to counteract a potential summing error due to length tolerances of the panel material 2. This option may also be used as a means of feeding one or more panels 2 which are not of the same length individually or in parallel through the printing station 3, and the stop element 34 is triggered after each of the individual panels 2 is sensed by one of the detection devices 35 and/or 41 and is moved into the position extending into the transport path.

Figure 3:
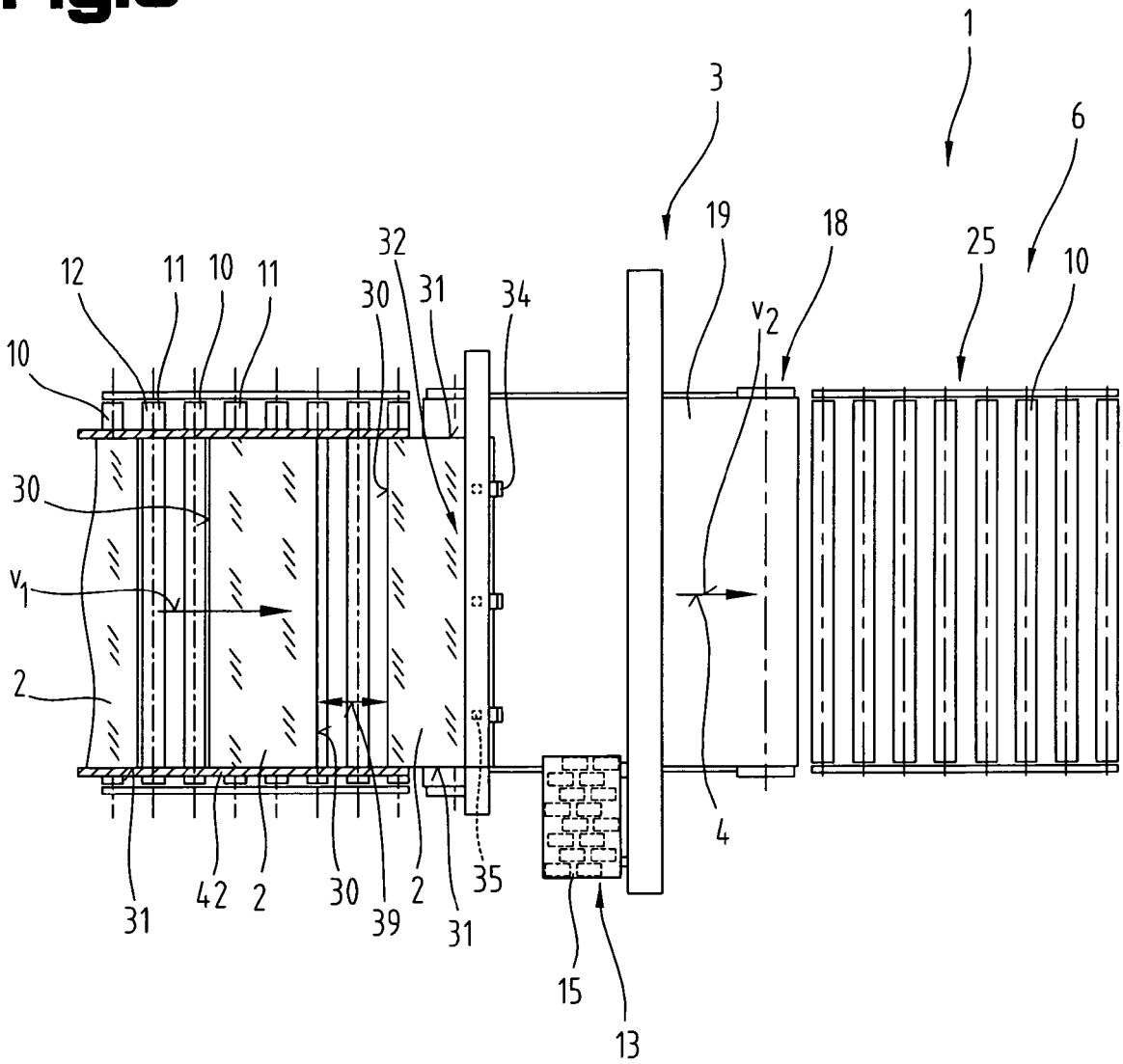
FIG. 3 is a highly simplified, schematic diagram illustrating a plan view of another way of disposing the panel material in a plant for printing it.

FIG. 3 illustrates another embodiment of the plant 1, which may be construed as an independent embodiment in its own right, the same reference numbers and component names being used as those used for FIGS. 1 and 2 described above. To avoid unnecessary repetition, reference may be made to the more detailed description of FIGS. 1 and 2 above.

As illustrated in a simplified format, the panel material 2 is of a long and slim format in the transverse direction and is therefore fed through the printing station 3 with the shorter end face 31 in a parallel orientation with the transport direction 4 and seamlessly printed. Making use of the full printing width by printing in landscape format likewise increases the productivity of the printing machine or plant 1. In this instance, the longer end faces 30 lie side by side in contact with one another and the same method sequence can be run as that described above.

For the sake of good order, finally, it should be pointed out that, in order to provide a clearer understanding of the structure of the plant 1, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1, 2; 3 constitute independent solutions proposed by the invention in their own right. The objectives and associated solutions proposed by the invention may be found in the detailed descriptions of these drawings.

LIST OF REFERENCE NUMBERS

1 Plant
2 Panel material
3 Printing station
4 Transport direction
5 Feeding station
6 Discharge station
7 Bed plane
8 Standing plane
9 Table frame
10 Support element
11 Drive means
12 Drive roller
13 Inkjet printing device
14 Print head
15 Print carriage
16 Support arm
17 Printing table
18 Conveyor system
19 Conveyor belt
20 Bed plane
21 Printing region
22 Orifice
23 Print start
24 Print end
25 Pick-up table
26 Bed plane
27 Panel thickness
28 Side face
29 Side face
30 End face
31 End face
32 Inlet region
33 Pressing mechanism
34 Stop element
35 Detection device
36 Row
37 Row
38 Row
39 Distance
40 Position
41 Detection device
42 Guide element
43 Detection device

What is claimed is:

1. A method of printing panel materials with printed images, comprising the steps of:

(a) feeding in a transport direction each panel material from a feeding station into a printing station using a conveyor system, the panel materials being disposed directly one after another in a row at least in an inlet region of the printing station, wherein the panel material in the feeding station is fed to the printing station at a feed rate higher than a feed rate of the conveyor system in the printing station, wherein the distance between the panel materials disposed one after another in the row is reduced until this distance has been completely eliminated via the higher feed rate of the panel material through the feeding station, (b) moving the panel materials jointly through the printing station, and (c) applying a respective printed image on the panel material while the panel material is in the printing station using an inkjet printing device.

2. The method as claimed in claim 1, further comprising: feeding the panel materials disposed immediately one after the other in a row in the transport direction into mutual abutment by end faces facing one another.

3. The method as claimed in claim 1, further comprising: orienting the panel materials to be printed parallel with the transport direction in the feeding station.

4. Method as claimed in claim 1, wherein several rows of panel materials are disposed adjacent to one another by reference to the feed direction and parallel with one another in the feeding station.

5. Method as claimed in claim 4, wherein the rows of panel material are disposed at a distance apart from one another by reference to the transport direction.

6. The method as claimed in claim 1, further comprising: holding the panel material stationary to the conveyor system as said panel material is fed through the printing station.

7. The method as claimed in claim 6, further comprising: suctioning the panel material onto the conveyor system via application of negative pressure.

8. The method as claimed in claim 1, further comprising: pressing the panel material against the conveyor system using a pressing mechanism disposed in the inlet region of the printing station.

9. Method as claimed in claim 1, wherein at least one stop element is provided for the row of panel material to be printed in the inlet region to the printing station, which can be moved from a position extending into the transport path of the panel material into a position releasing the transport path.

10. The method as claimed in claim 9, wherein the panel materials are fed in a plurality of rows and at least one stop element is provided for each row of said plurality of rows.

11. Method as claimed in claim 10, wherein at least one detection device is provided for each of the rows of panel material to be printed in the inlet region to the printing station, and the presence of the panel material is detected by said at least one detection device.

12. Method as claimed in claim 11, wherein when the at least one detection device detects the presence of a row of the panel material, a first signal is emitted and the stop element of this row of the panel material is moved from the position extending into the transport path into the position releasing the transport path.

13. Method as claimed in claim 12, wherein, after the stop element or elements has or have moved, the panel material is conveyed into a printing region of the printing station.

14. Method as claimed in claim 10, wherein if there are several rows of panel material disposed adjacent to one another in the transport direction, each row has an associated detection device that emits a first signal, as a result of which each stop element co-operating with each of the respective rows is moved out of the position extending into the transport path into a position releasing the transport path simultaneously.

15. The method as claimed in claim 10, wherein at least one detection device is provided for each row, placed near the at least one stop element for detecting the presence of each panel material, and wherein a signal is emitted if the detection device does not detect the presence of panel material in the row, to cause the at least one stop element to move from the position releasing the transport path into the position extending into the transport path.

16. The method as claimed in claim 9, further comprising: stopping feed of the panel material in the feeding station when the at least one stop element is in the position extending into the transport path.

17. The method as claimed in claim 9, further comprising: continuing the feeding of the panel material still disposed in the printing station until the printed image has been fully printed when the at least one stop element is in the position extending into the transport path.

* * * * *